United States Patent [19]

Hayes et al.

[11] Patent Number: 5,040,691

[45] Date of Patent: Aug. 20, 1991

[54] CHILD-RESISTANT, EASY OPENING PACKAGE

[75] Inventors: Thomas H. Hayes, Lancaster; Lewis C. LoMaglio, Pickerington, both of Ohio

[73] Assignee: Anchor Hocking Packaging Company, Lancaster, Ohio

[21] Appl. No.: 450,039

[22] Filed: Dec. 13, 1989

[51] Int. Cl.[5] ..... B65D 55/02

[52] U.S. Cl. ..... 215/216; 215/206; 215/235; 215/237

[58] Field of Search ..... 215/224, 225, 221, 218, 215/216, 206, 235, 237

[56] References Cited

U.S. PATENT DOCUMENTS

| | | | |
|---|---|---|---|
| 3,633,779 | 1/1972 | Field | 215/221 |
| 4,099,639 | 7/1978 | Boxer et al. | 215/221 |
| 4,467,931 | 8/1984 | Gach | 215/250 |
| 4,533,058 | 8/1985 | Uhlig | 215/216 |
| 4,613,051 | 9/1986 | Swartzbaugh | 215/225 |
| 4,629,081 | 12/1986 | McLaren | 215/224 |
| 4,669,622 | 6/1987 | Bennett . | |
| 4,700,858 | 10/1987 | Bennett . | |
| 4,718,567 | 1/1988 | LaVange | 215/224 |
| 4,941,580 | 7/1990 | Julian | 215/225 |

FOREIGN PATENT DOCUMENTS

| | | | |
|---|---|---|---|
| 307196 | 3/1929 | United Kingdom | 215/235 |

*Primary Examiner*—Stephen Marcus
*Assistant Examiner*—Paul Schwarz
*Attorney, Agent, or Firm*—Wood, Herron & Evans

[57] ABSTRACT

Disclosed is a package having a closure which provides child resistance with optional easy opening and closing features. The closure is permanently but rotatably attached to the container finish, and is held on the container by snap engagement with the container or with an adapter which is separately attached to the container. The closure has a depending skirt which encircles a latching flange on the container or on the adaptor. A hinged lid on the closure has a latch which is latchable beneath the latching flange only if the closure is turned to a position such that the latch is aligned with a latch slot in the latching flange. Rotation of the closure relative to the slot, once the latch has been engaged through the slot, locks the lid against opening.

25 Claims, 2 Drawing Sheets

CHILD-RESISTANT, EASY OPENING PACKAGE

FIELD OF THE INVENTION

This invention relates to a container closure which combines the feature of resistance to opening by small children with the feature of optional ease of opening by adults. The invention also includes tamper indicating features.

BACKGROUND OF THE INVENTION

In recent years legislation has been enacted which requires that containers for certain products such as aspirin and other drugs have closures which are "child resistant", that is, which cannot easily be opened by a child by simply unscrewing a cap or pushing it off with the thumb. One type of child resistant closure requires that the cap first be rotated to a certain angular position on the container, and then lifted at that position. Another type requires that the cap be pushed toward the container ("palmed") to engage ratchets or threads so that it can be unscrewed. The theory underlying child resistance is that it is conceptually difficult for a small child to appreciate the need to carry out two diverse types of movement simultaneously or sequentially.

However, it is also difficult for some adults to open and/or close some child resistant closures, as for example those in whom arthritis has caused a loss of mobility and dexterity in the fingers. The great majority of child resistant closures require increased force (for example, about two pounds) to open and/or close the cap, but a significant number of adults are unable to exert even this threshold level of force and thus they are effectively prevented from opening such containers. Because of this, some adults deliberately leave a container open to avoid the effort of opening it again; and some actually cannot exert the force necessary to close it once it has been opened. Because typical child resistant closures cannot easily be used by some adults, it has been necessary for suppliers to continue to stock some items in containers with ordinary (non-child resistant) closures, so that a container with either mode of opening can be selected at the time of purchase. There is some evidence that the preference for non-child resistant closures is increasing, which of course increases the risk to children. Thus, there is a need for a closure which will simultaneously or optionally provide the somewhat antithetical requirements of child resistance and selective ease of opening and closing by adults.

Tamper indicating means, another closure safety feature, have a different objective. Their purpose is to provide a clear visual indication that a container has previously been opened which, in the instance of goods on the shelf awaiting purchase, could signify tampering. Usually tamper indication is provided by a band or cover which must be removed, separated, or torn before the closure can be opened, and which thereby gives a visual indication of opening.

However, the operation of tamper indicating means generally tends to slow the opening of a container. In some previous containers which combined tamper indicating with child resistant features, several separate barriers must be sequentially removed before the container can be opened. For example, it is sometimes necessary to tear open a glued carton or remove a shrink band or an inner seal from the top of the container after a child-resistant cap has first been removed. It may be necessary to use an implement such as a knife or scissors to effect the removal. Moreover, once removed, a separable tamper indicating band or wrapper may become litter, or may be chewed or even swallowed by a child. These complicating factors detract from the provision of tamper indicting means.

Yet another problem with some previous containers is that the cap, once removed, is separated from the container and can be misplaced. It cannot be left on or remain attached to the container in a closed but easily openable condition, for ease of use by an adult who does not want child resistance.

Accordingly, there has been a need for a "universal" closure which combines features of (a) child resistance, such that the closure cannot easily be opened by a young child; (b) optional easy opening by adults who might have limited manual strength or dexterity; (c) ease of reclosing; (d) permanent attachment of the closure to the container; (e) absence of littering; and (f) optional automatic tamper indication, to show if the container has previously been opened.

THE PRIOR ART

One type of child resistant closure which is in widespread commercial use (for example on certain "EXCEDRIN brand analgesic" packages) does not require alignment and requires only thumb force to remove it. That closure has a unitary cover and skirt. An inwardly extending rib on the skirt snaps below an uninterrupted, outwardly extending latching flange or bead around the finish of the container. The closure is removable from the container and is flexible and somewhat elastic to enable the skirt to be "stretched" to fit over the bead on the finish. The skirt has outwardly projecting tab under which the thumb can be engaged to pry off the closure. A blocking or lower flange extends outwardly around the finish, beneath the closure; when snapped on, the closure fits close to the blocking flange.

Another type of closure, used on other "EXCEDRIN" packages, can be opened only if a thumb tab on the closure is made accessible to thumb force by turning the closure until the tab is aligned with an opening or slot in a blocking flange. To remove the closure, sufficient force must be used to snap a detent over a latching flange, even with the tab aligned. The closure is removable from the package and can be snapped on at any position.

Yet another type of child resistant package, used for "ADVIL brand" pain relievers, requires closure alignment for both closing and opening, but can be easily opened and closed if aligned. It has a latching flange around the finish and a blocking flange spaced below that. A skirt on the closure encircles the latching flange, the skirt having an outwardly projecting thumb tab and an inwardly projecting detent, radially in line with the thumb tab. On the opposite side of the skirt from the detent, two ribs project inwardly from the skirt. Only if the ribs are first seated beneath the latching flange and the detent is aligned with the slot can the closure be applied; nor can it be removed unless the detent is aligned with the slot. The closure is not attached to the container.

Bennett U.S. Pat. Nos. 4,669,622 and 4,700,858 show containers having integral snap-close lids with living hinges.

BRIEF DESCRIPTION OF THE INVENTION

In accordance with this invention, the closure is permanently attached to the container, by snapping it onto the container or onto an adapter which is connected to the container. The closure has a generally cylindrical skirt, to which a lid is hinged. The lid has a latch which passes through a slot in the skirt and which can engage beneath a latching flange to latch the lid in a closed position. (The latching flange may be provided on either the container or the adapter, and can also be used to connect the closure to the adapter.) Though permanently attached, the closure can be rotated relative to the container to align the latch with a narrow slot in the latching flange, in which the latch must be positioned for latching. Child resistant operation is selectable at the user's option, simply by closing the lid and turning the latch away from the slot in the latching flange. A strap covers the latch to prevent it from being lifted from the bottom and/or the closure removed.

Tamper indicating means is preferably provided by two separate but automatically operating features. The lid is preferably formed in closed position on the skirt and secured initially in that position by a series of small rupturable or frangible bridges around it. A thin tearable film or membrane (referred to as a "guarantee seal") may be adhesively or thermally secured from side to side of the closure across the lid, to block tampering. Both the bridges and the seal are required to be broken before the lid can be fully lifted, and they are automatically ruptured when the lid is first opened. The lid is preferably connected to the closure by a living hinge and, if opened, is held in the open position. The hinge is preferably bi-stable, that is, it holds the lid in both the open and closed positions.

DESCRIPTION OF THE DRAWINGS

The invention can best be further described by reference to the accompanying drawings in which.

DETAILED DESCRIPTION

Figure 1:
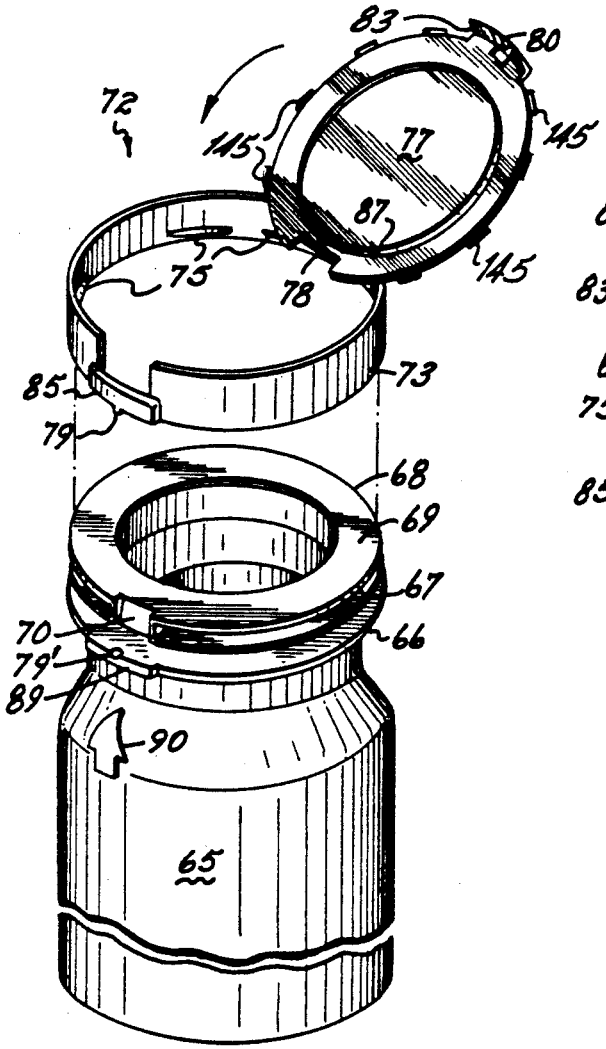
FIG. 1 is an exploded perspective view of a container with a closure secured directly to a container, in accordance with a preferred embodiment of this invention, with the lid in open position.
Figure 3:
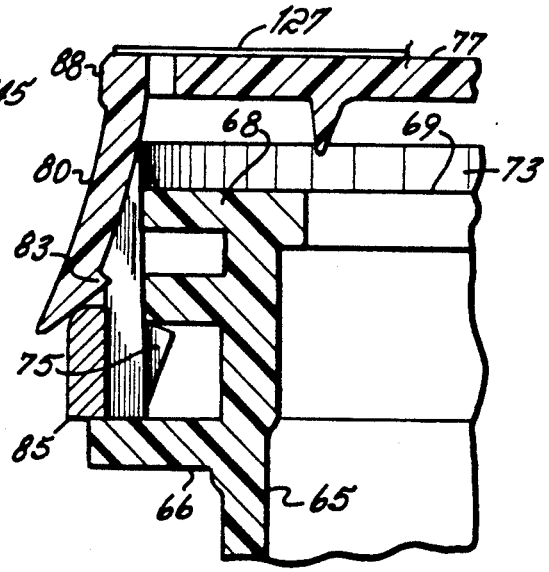
FIG. 3 is a cross-sectional view of the container and closure showing the lid in disaligned, unlatched position.
Figure 2:
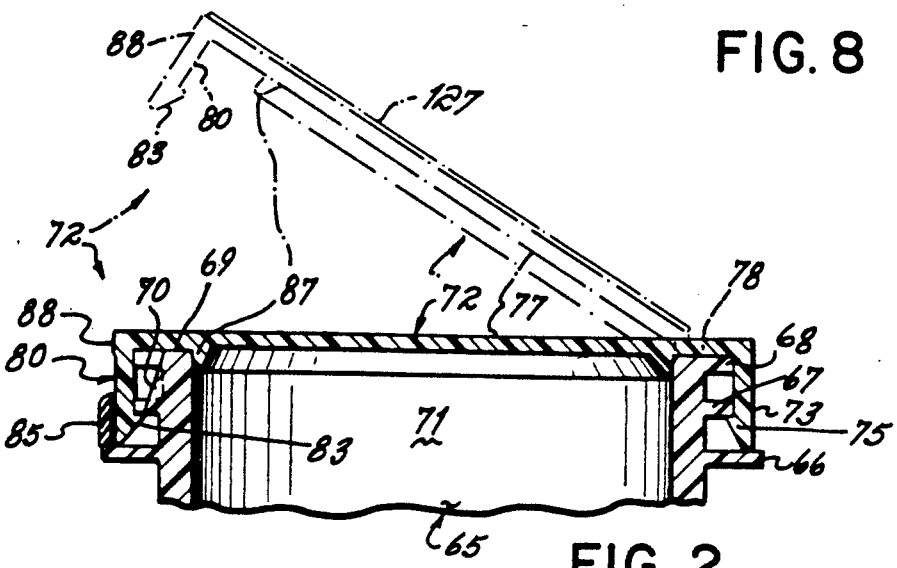
FIG. 2 is an enlarged partial axial section of the container finish and closure of FIG. 1.

In the first and presently preferred embodiment of the invention, illustrated in FIGS. 1-3, a closure is provided which is especially adapted for use with containers which can be molded with sufficient precision (for example, by injection blow molding) that the lid can reliably latch directly to the container itself. In this embodiment, no separate adapter part is needed to provide a reliable interfit with the container; the closure is attached directly to a peripheral flange around the container itself, rather than to a separate adapter.

The container of the first embodiment has at least two axially spaced flanges around its finish: a lower or blocking flange 66, and a latching flange 67 above the blocking flange. Preferably the container also has a top flange 68, above latching flange 67, with a flat shelf or top surface 69, but it should be understood that the latching flange can be at the top of the finish and thus itself serve as both the latching flange and a top flange. Lower flange 66 is continuous around the finish, and is of larger diameter than the latching flange and top flange (if present). The latching flange 67 and top flange are of reduced width at an opening in the form of a latch slot 70. Closure 72 has an annular circumferential skirt 73 which encircles and extends below latching flange 67. Interengaging means secure the closure to the container, so that it cannot be removed without destruction. The interengaging means preferably comprise inwardly projecting detents or interrupted ribs 75 around the skirt which engage beneath an attaching surface of the container. The attaching surface preferably comprises latching flange 67 (see FIG. 2). An outwardly spaced strap or bridge 85 connects the skirt 73 across slot 70, thereby effectively preventing the skirt from being spread open to release the closure from the container. The closure is thus rotatable on the container but cannot be removed from it. Lower flange 66 blocks access to skirt 73 from below so that the closure cannot be pried up.

Closure 72 includes a lid 77 which preferably is hinged to skirt 73 by a bi-stable living hinge such as that shown in Bennett U.S. Pat. No. 4,700,858, to which reference may be had. When the lid is open (FIG. 1) the periphery of the lid on each side of the hinge is biased downwardly against top surface 69, to hold the lid open. Opposite hinge 78, a latch 80 projects downwardly from lid 77.

Figure 5:
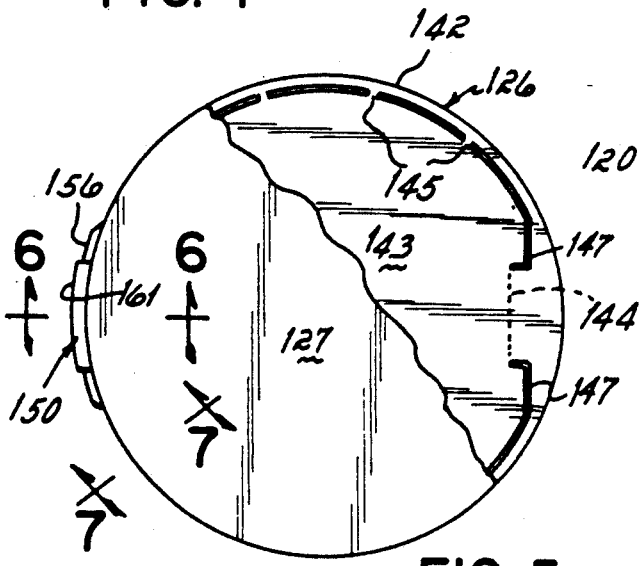
FIG. 5 is a top plan view of an assembled closure of the type shown in FIG. 4, with a guarantee seal secured across the lid.

The lid is formed in the down position and, as formed, is preferably connected to skirt 73 by frangible bridges 145, best shown in FIG. 5. A hook, latching lug, or detent 83 on latch 80 is engageable beneath latching flange 67 to tightly lock the lid in closed position in all rotational positions except where the latch is aligned with slot 70. When the latch is aligned in the slot, it drops inside bridge 85 but only lightly or partially hooks under the flange 67. The latch will not engage under latching flange 67 at any other angular position; the flange and bridge 85 cam it outwardly so that it cannot fit between bridge 85 and the flange (FIG. 3). When the lid has been closed with the latch in aligned position, and then turned from that position, hook 83 is engaged below flange 67 and holds the lid tightly locked (FIG. 2).

The underside of the lid may optionally have a circular rib or a plug fitment 87 which fits snugly within the top opening 71 of the container. This provides a better seal after the container has been opened initially.

Industry tests have shown that the instinct of most children is simply to turn a cap, as if to unscrew it. With conventional child resistant lids, as with the present lid, turning a lid that has been closed and left in the aligned position, locks it. However, the conventional child resistant closures can sometimes be opened if a child should happen to pull up on the lid as he rotates the latch past the latch slot on the container. In contrast, it is an important advantage of this invention that the closure provides better security than conventional turn and align child resistant closures. Even if one pulls up on the closure as it is rotated, it will open only if the latch 80 itself is both pulled and rotated into the slot. Pulling up on any other part of the closure is ineffective. This adds a second element of chance to the improbability of opening by a child, and thus provides better security. Moreover, the present closure is more easily closed and locked than conventional child resistant caps, because latching and turning is accomplished in one easy, unforced, sequential motion.

Tamper evidencing means, if desired, can be incorporated in various ways, as by using a tear-away band around the lid. Preferably, however, a tearable guarantee seal 127 is applied over lid 77 and adhered to the annular top edge of the skirt 73 (seal 127 is also shown in FIGS. 4–7). When the lid is first lifted, the tamper evident seal is automatically torn, thereby visibly showing tampering. A further advantage of a top guarantee seal is that it is easily printable and thus can present instructions. Alternatively, a tearable seal can be applied across the undersurface of the lid or across the top of the container, where it must also be torn to access the contents of the container.

An alignment arrow 90 can be molded or otherwise formed on the shoulder or side of the container (FIG. 1) and on the top surface of the lid to show the position at which latch 80 must be aligned for opening. If a tamper evidence seal is used on top of lid 77, an arrow can be printed on it. The position of alignment can also be indicated, as the closure is rotated, by engagement of a detent and notch 79, 79' between the closure and container. Blocking flange 66 is preferably wider, as at 89, in the area immediately below slot 70, to enable the position of latch alignment to be detected by touch, for ease of use by those with impaired vision.

To open the closure initially when it is sealed, it is turned rotationally on container 65 until latch 80 is centered in slot 70. The latch is disengaged from flange 67 and lid 77 is lifted by engaging the thumb or finger or the like under latch lifting rib 88 and lifting it (FIG. 2). The initial opening of the lid automatically accomplishes two things: it snaps the bridges 145 around the lid, and it tears or ruptures the tamper evident seal along a circular line between the lid and skirt.

Once the closure has been opened initially, it can thereafter be used in either of two modes. To provide child resistance, lid 77 is closed and then is turned on the container to disorient the latch from the slot, so that hook 83 is locked beneath flange 67. Minimal force (e.g., only one-half pound) is required to close the lid at the slot because the latch is cantilevered and relatively flexible; no snap need be overcome. The latch is secured by turning the closure on the container, from aligned position. Once closed, the lid need not be further depressed to turn it from or to the latching position. On the other hand, if child resistance is not needed, for example for use by an adult, then the latch can be left in the slot. At that position hook 83 engages only lightly under flange 67 and the lid can be opened simply by lifting it; no rotational adjustment is required, and there is little snap force to overcome. In fact under those conditions the closed package can be opened with one hand, simply by holding the container in the palm and lifting the lid with the thumb. Other types of easy-open closures usually require two hands.

Hinge 78 can provide bi-stable lid positioning in which the lid is biased either toward the down (solid line) position shown in FIG. 2 or alternatively, toward (dotted line) an upright position. When open, lid 77 is not detached but remains connected to the container by the hinge. Thus the lid cannot be separated or lost, and the fact that it remains connected tends to promote reclosure.

As can be seen the closure is easily adaptable or convertible to either child resistant operation or to easy-open operation. Opening does not result in the generation of any separate litter: no peel away strip is necessary, and no separate tamper indicating band. The severed part of the guarantee seal remains attached to the skirt edge and the lid.

In the second embodiment of the invention, illustrated in FIGS. 4–7 of the drawings, a closure is provided which is especially adapted for use with types of containers which present imprecisely formed finish surfaces, for example, glass containers and extrusion blow molded containers. This embodiment uses an adapter to mount the closure to the container. An optional tamper indicating seal can also be included.

Figure 4:
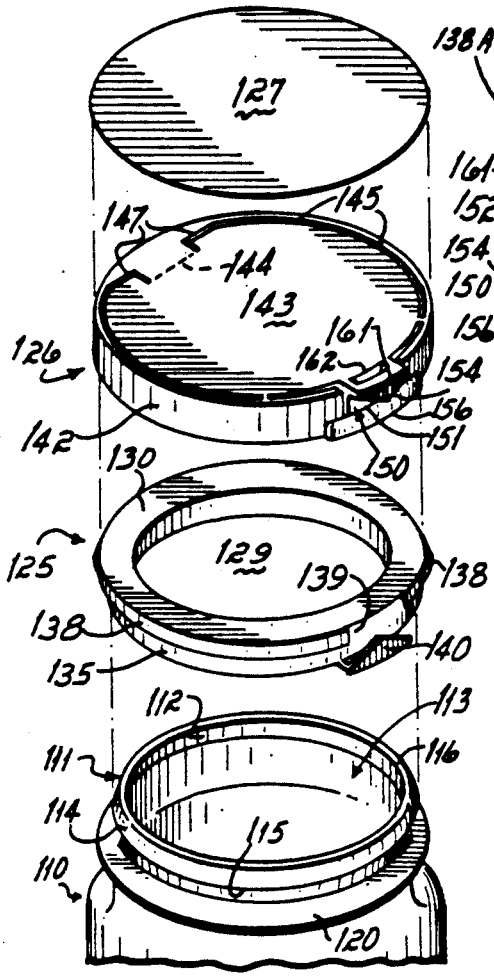
FIG. 4 is an exploded perspective view of a container with a closure that is securable to an adapter which is in turn securable to the container, in accordance with a second embodiment of the invention.
Figure 6:
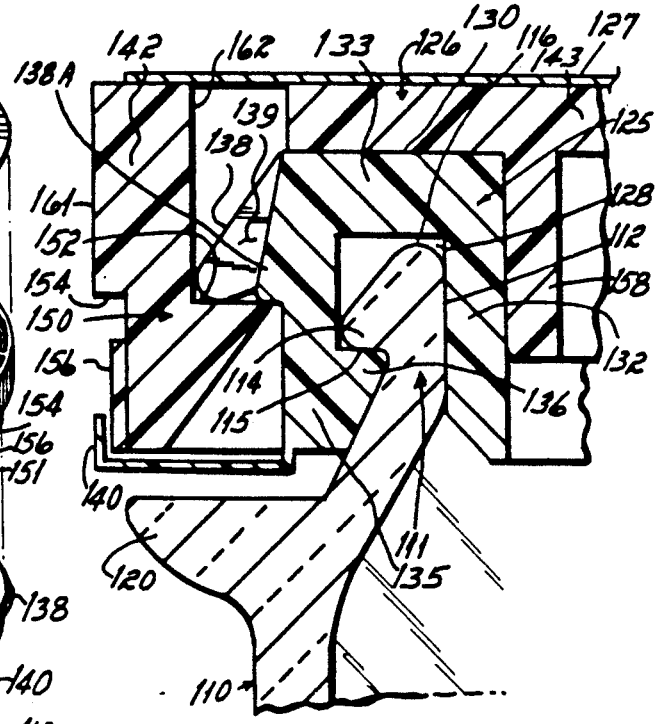
FIG. 6 is an enlarged partial axial section taken on line 6—6 of FIG. 5, also showing the finish of the container.

Referring to FIG. 4, a container designated generally by 110 has a finish 111 with a generally cylindrical inside wall 112 and a top edge 116 around the opening 113 of the container. Around the outside of finish 111 is a peripheral tapered bead, ledge or rib 114 which presents a downwardly facing connecting ledge 115 (FIG. 6). Below connecting ledge 115 the container wall flares outwardly to a blocking shoulder or flange 120. (This flange corresponds to lower flange 66 of the first embodiment.) Flange 120 and connecting ledge 115 are generally parallel to one another and face oppositely, flange 120 facing upwardly and ledge 115 facing downwardly.

In this second embodiment a separate adapter 125 is mounted to the container and the closure 126 is mounted to the adapter. The adapter is in the form of an annular band which is snapped over top edge 116 of container finish 111. Closure 126 includes a hinged lid 143 and is snapped rotatably onto adapter 125. As in the first embodiment, a non-removable, non-littering tamper indicating seal 127 is preferably secured across the lid of the closure 126.

Adapter 125 has a flat top surface 130 around a central opening 129 and presents a downwardly opening groove or channel 128 which snaps and permanently locks around finish top edge 116. (Surface 130 corresponds to top surface 69 of the first embodiment.) Channel 128 presents a generally cylindrical inner apron 132 (which facially engages the inside surface 112 of finish 111, see FIG. 6), an outside wall 135, and an inwardly projecting snap edge or detent 136 which is engageable beneath ledge 115 to lock adapter 125 to the container. When so snapped on, the adapter cannot be removed from the container without destroying it. Container shoulder 120 blocks access to detent 136 from below so as to make it virtually impossible, as a practical matter, to pry the detent 136 out of its engagement with ledge 115.

Adapter 125 presents a downwardly and outwardly (conically) angulated latching flange 138 which completely encircles it except at a slot 139 (see FIG. 4), at which the flange is interrupted. (Flange 138 of this embodiment provides a latching function similar to that of flange 67 of the first embodiment.) As in the first embodiment, the width of this slot determines the range of positions in which closure 126 must be rotationally aligned on adapter 125 to permit the lid to be opened. The width of gap 139 may be in the range of approximately 3/16 to ¾". An outwardly spaced, upwardly pointing arrow or marker 140 may be provided to show the center of slot 139, i.e., to mark the opening position.

Figure 7:
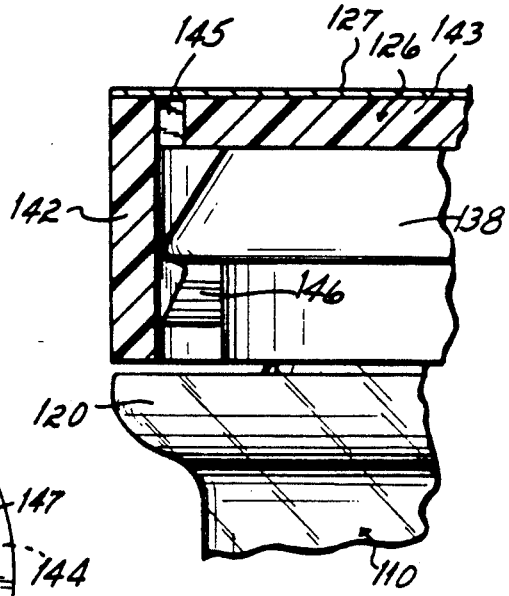
FIG. 7 is an enlarged partial axial section similar to FIG. 6 but is taken on line 7—7 of FIG. 5.

Closure 126 is permanently secured to but rotatable on adapter 125. The closure includes a cylindrical skirt 142 which encircles the adapter 125. As seen in FIG. 7, detents 146 on the inside of skirt 142 engage beneath latching flange 138 so that the closure is secured axially on connector 125 but is rotatable about it. A lid 143 which may be semicircular is formed integrally in the top of closure 126 and is connected to skirt 142 by a living hinge 144 so that it is openable to provide access through opening 129 of adapter 125, to container opening 113. As formed, lid 143 is preferably but not necessarily connected to the top edge of skirt 142 by a series of frangible bridges 145 (FIG. 5; see also FIG. 1) around its peripheral edge or in the gaps 147 adjacent hinge 144. These bridges initially hold the lid in a closed position with respect to the skirt, and the lid cannot initially be opened without breaking them, thereby providing another indication of opening, in addition to seal 127.

Diametrically opposite hinge 144 a cantilevered, leaf spring or latch 150 projects downwardly from lid 143, into a slot 151 in skirt 142. As shown in FIG. 6, a hook 152 projects inwardly from the inner end of latch 150. Hook 152 is shaped to snap under latching flange 138 of adapter 125. Flange 138 may be undercut as shown in FIG. 6, and hook 152 may project upwardly to engage in the undercut for greater security. A connecting strap 156 or bridge connects the skirt across slot 151, and thus prevents spreading the skirt to remove the closure from the connector. When lid 143 is closed and is turned to disorient hook 152 from slot 151, the hook is retained beneath flange 138 and holds the lid positively secured. The lid can be opened only if oriented angularly so that latch 150 is within slot 139 (as shown in FIGS. 4, 5, and 6). When so oriented, the lid can be opened with the thumb or another finger engaged beneath the lower edge 154 of a latch indicator arrow 161 on the latch. It is preferred that flange 138 be of reduced depth (as at 138A) but not eliminated in the slot, in order to prevent the lid from popping up, if left unsecured. The opening 162 in lid 143 above hook 152 facilitates injection molding of hook 152 from the top. As can be seen in FIG. 6, flange 120 blocks access to the latch from below so that it cannot be opened if not aligned.

Optionally, closure 126 may have a downwardly depending annular plug seal or skirt 158 on its undersurface (see FIG. 6), sized and positioned to fit neatly inside the inner apron 132 of connector part 125. This skirt aligns and maintains the lid centered with respect to the container opening 113, also provides an effective moisture seal when the lid is in the closed position and helps to prevent lid opening if left unsecured.

As in the first embodiment, a shearable or tearable tamper evidencing seal of foil or other suitable material 127 is preferably secured to both the lid and the upper edge of skirt 142. Alternatively, a seal may be secured directly onto the top edge 116 of the container, beneath adapter 125, or alternatively onto the top surface 130 of the adapter. As is apparent from FIG. 5, seal 127 can be directly engaged by heating means for sealing, making it unnecessary to use induction heat sealing.

The closure of this second embodiment is applied to a container by snapping adapter 125 onto the container so that snap rim or detents 136 are engaged beneath container connecting ledge 115. Once so positioned, the adapter cannot thereafter be removed. (The adapter may or may not be rotatable on the container, but any such rotation does not remove it.) As can be appreciated, adapter 125 can be specially molded to provide a more dimensionally and positionally precise latching flange for engagement by latch hook 152 than is normally formed in a glass container. Closure 126 is snapped onto adapter 125 by engaging its detents beneath flange 138.

Figure 8:
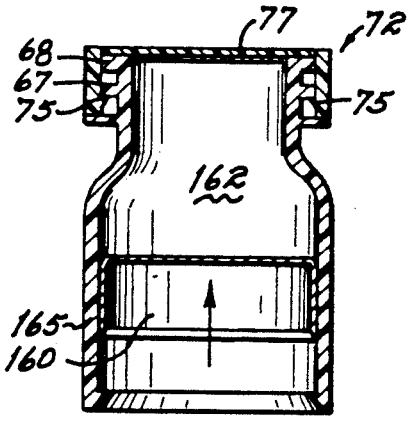
FIG. 8 is an axial section of a third embodiment, in which a closure is mounted on a modified container.

FIG. 8 shows another embodiment in which a one-piece closure, which may be similar to that of FIGS. 1–3, is mounted on a vial or container 165 which is especially adapted for use by pharmacies as a dispensing container. This container has a closure which can be the same as that shown in FIGS. 1–4, but the container to which it is mounted is molded open at the bottom and it is fitted with a separate fitment or plug 160 which is movable upwardly only in the container. Unlike conventional vials used by pharmacists to dispense tablets, this container 165 is filled from the bottom. The bottom plug 160 may be a plastic non-removable valve plug which can be pushed up sufficiently to prevent pills from rattling in chamber 162, thereby reducing "dusting" of the pills (cotton is presently used for this purpose). This arrangement can reduce different vial sizes used by pharmacies.

Having described the invention, what is claimed is:

1. A child-resistant, easy open and close package comprising, a container having a top opening and a closure mounted on said container for closing said opening, said container and said closure having interengaging means securing the closure on the container, means separate from said closure presenting a latching flange around said opening, said closure having an annular skirt which extends around said latching flange, said closure including a lid hinged to it for closing said opening, means separate from said closure presenting a top flange having a top surface against which said lid facially engages when said lid is closed, said lid having a latch projecting from it for latching engagement with said latching flange to secure said lid over said opening, said latching flange being interrupted by a slot, said closure being rotatable with respect to said latching flange to align or disalign said latch with said slot, said latch securing said lid if said latch is passed through said slot and then turned from said slot.

2. The package of claim 1 wherein said interengaging means comprise detents on an inside surface of said skirt, and an attaching surface which is not removable from said container, said detents engaged with said attaching surface to secure said closure against removal from said container.

3. The package of claim 2 wherein said attaching surface is integral with said container.

4. The package of claim 2 wherein said attaching surface is presented by an adapter which is secured to said container.

5. The package of claim 2 wherein said attaching surface is a lower surface of said latching flange.

6. The package of claim 1 further wherein said container includes a blocking flange, said blocking flange sized and positioned to block access to said interengaging means and thereby hinder removal of said closure from said container.

7. The package of claim 1 further wherein said lid seats within said skirt.

8. The package of claim 1 further wherein said skirt includes a bridge which extends across said slot, said bridge preventing said skirt from being spread.

9. The package of claim 1 further wherein said latch includes a lifting rib which is accessible in said slot to lift said lid.

10. The package of claim 1 wherein said hinge is a living hinge.

11. The package of claim 1 further wherein a series of rupturable bridges connect said lid to said skirt.

12. The package of claim 11 wherein said bridges lie in the plane of said lid.

13. The package of claim 11 wherein said bridges are around the periphery of said lid.

14. The package of claim 1 further including a tearable seal which is secured across said lid and said skirt.

15. A child-resistant, easy open and close package comprising a container and a closure unremovably mounted onto said container, said container having a top opening a latching flange, said closure having a hinged lid for closing said top opening, and an annular skirt around said latching flange, a top flange against which said lid facially engages when said lid is closed, interengaging means on an inside surface of said skirt, said interengaging means engaged beneath said latching flange and securing said closure against removal from said container, said lid being openable with respect to said skirt and having a flexible latch projecting downwardly from it for latching engagement with said latching flange to secure said lid over said opening, said latching flange being interrupted by a slot in which said latch is receivable, said closure being rotatable with respect to said container to align or disalign said latch with said slot, said latch if aligned with said slot not locking said lid, said latch securing said lid when said latch has been passed through said slot and then turned from said slot.

16. The package of claim 15 further wherein said container includes a blocking flange below said latching flange, said blocking flange sized and positioned to block access to said interengaging means and thereby prevent said closure from being removed from said container.

17. The package of claim 15 further wherein said interengaging means comprises a series of detents on an inside surface of said skirt engageable beneath said latching flange.

18. The package of claim 15 further wherein said skirt includes a bridge which extends across said slot, said bridge preventing said skirt from being opened to remove said closure from said container.

19. The package of claim 15 further wherein said latch includes a lifting rib for lifting said lid.

20. The package of claim 15 wherein said hinge is a living hinge.

21. The package of claim 15 wherein said hinge is bi-stable.

22. The package of claim 15 further wherein a series of rupturable bridges connect said lid to said skirt around the lid.

23. The package of claim 15 further including a severable seal which is secured across said lid and said skirt.

24. The package of claim 15 wherein said latch is a spring latch which is cantilevered downwardly from said lid.

25. The package of claim 15 wherein said container has a bottom which is shiftable upwardly to reduce the volume within said container.

* * * * *